US005367896A

United States Patent [19]

Sundberg

[11] Patent Number: 5,367,896

[45] Date of Patent: Nov. 29, 1994

[54] KEY HOLDER

[76] Inventor: Carl B. Sundberg, P.O. Box 519, Wilbraham, Mass. 01095-0519

[21] Appl. No.: 78,894

[22] Filed: Jun. 21, 1993

[51] Int. Cl.[5] ..... A44B 15/00

[52] U.S. Cl. ..... 70/457; 70/458; 206/37.1; 206/38.1

[58] Field of Search ..... 70/456 R, 456 B, 457, 70/458, 459, 460; 24/3 K, 598.2, 601.3; 206/38.1, 37.8, 37.1; D3/207, 208, 210

[56] References Cited

U.S. PATENT DOCUMENTS

| | | | |
|---|---|---|---|
| D. 308,757 | 6/1990 | Sanford | D3/208 |
| 345,407 | 7/1886 | Besse | 24/598.2 X |
| 419,373 | 1/1890 | Souders | 70/458 X |
| 482,670 | 9/1892 | Ackerman . | |
| 988,960 | 4/1911 | Prigge, Jr. . | |
| 1,052,802 | 2/1913 | Dean | 70/459 |
| 1,421,876 | 7/1922 | Weed | 24/3 K |
| 1,462,205 | 7/1923 | Korns . | |
| 1,817,246 | 8/1931 | Gardine . | |
| 2,019,691 | 11/1935 | Morehouse | 70/456 B X |
| 2,232,668 | 2/1941 | Schupbach | 70/459 |
| 3,884,059 | 5/1975 | McKee | 70/458 X |
| 4,422,315 | 12/1983 | Klose | 70/456 R |
| 4,597,139 | 7/1986 | Lau | 24/67.9 X |
| 4,951,361 | 8/1990 | Stephens, Jr. | 24/3 K |
| 4,976,124 | 12/1990 | Sanders | 70/458 |

FOREIGN PATENT DOCUMENTS

| | | | |
|---|---|---|---|
| 1098583 | 8/1955 | France | 70/456 R |
| 69835 | 2/1915 | Germany | 70/458 |
| 447091 | 4/1926 | Germany | 70/458 |
| 467748 | 6/1937 | United Kingdom | 70/459 |
| 0574508 | 1/1946 | United Kingdom | 24/601.3 |

*Primary Examiner*—Lloyd A. Gall

[57] ABSTRACT

A key holder is provided comprising a ring shaped element formed from a resilient coil of material wherein at least one end of the coil used to form the key holder extends into the area defined by the ring so as to form a push bar on to which a key or other such element may be threaded so as to facilitate adding or removing keys onto or from the key holder.

2 Claims, 3 Drawing Sheets

KEY HOLDER

BACKGROUND OF THE INVENTION

Key holders of the ring variety consist of a coil of one or more (usually two) turns of spring wire having chisel-shaped ends designed to be pried open with a knife blade or a strong fingernail to permit the insertion of a key over the thus exposed end of the coil and sliding of the key around the coil until the orifice of the key surrounds all of the turns of the coil. Such standard key rings have usually been cold-formed to press the coils into a smooth layered ring which is polished to prevent snagging of the ring when carried in a pocket or purse.

Some of the ring shaped key holders presently in use are difficult to use and can cause broken fingernails on attempting to spread the end of the coil away from the main part of the ring in order to add or remove keys from the ring. This difficulty is troublesome when one attempts to quickly remove a key or keys from the key holder while leaving a vehicle for repairs, service, valet parking and the like.

The present invention provides for convenience in adding or removing keys from a ring shaped key holder. The present invention, however, may also be adapted to retain other objects usually kept on key rings and the like.

SUMMARY OF THE PRESENT INVENTION

The present invention is directed to a ring type key holder wherein at least one end of the coil or loop that forms the ring extends into the area formed by the loop. The extended end, hereinafter referred to as a push bar, is designed to be pushed out away from the ring so that a key may slide over the push bar onto the ring.

In another embodiment one or more lobes are formed on the ring itself so as to isolate on the lobe one or more keys and to keep them separate from the other keys on the ring.

For purposes of the present invention, the key ring may be circular or formed in various non-circular shapes such as ovals, ellipses, triangles, rectangles and the like. The push bar is co-planar with the plane of the ring as will be described below. Preferred operation is achieved when the push bar extends across the area described by the ring in a configuration similar to a diameter or chord in a circle. The ring may be made of one piece of material of uniform composition and flexibility, or of flexible portions and non-flexible portions made of similar or different materials. A key, or other such element, enters the ring by threading it onto the push bar which has been pushed out to receive the key and then sliding the key in the same direction until it passes over the coils forming the ring and onto the ring. Removal of a key from the ring may be accomplished by sliding the key or like element over the push bar and off of the ring. Either adding or removing a key or other element from the ring may be accomplished.

The ring material should be inherently springbiased to return to its original configuration as a closed loop when the keys have been inserted or removed. This assures that the ring will not accidentally open to permit the loss of a key. Preferred operation is also achieved with ring materials having the characteristics of spring steel, that is, materials which are capable of relatively extreme bending or twisting without exceeding the elastic limit and taking a permanent set. The combined thickness of the respective end portions should be such as to easily pass through the orifices of the keys or other elements to be held by the ring.

It is a significant feature of the present invention that the key holder is manufactured so that when completely formed, and in static condition ready for use, the ring maintains its integrity such that the keys or other elements being held by the ring do not slip off of the ring. Thus the end of the push bar should be in contact with or at least in close proximity to the ring itself so as to retain the keys.

In operation, a key can be threaded onto the ring by sliding it over the push bar 11 and onto the ring portion of the key holder 10. In removing a key or other element, the key is removed by sliding it along the ring onto the push bar 11 section and off of the ring. Due to the spring like consistency of the ring, the ring tends to return to its original configuration once the pressure on the push bar is released. Attached keys or other elements are unable to "fall off" the ring because the holder returns to the retentive closed ring configuration.

It bears emphasis that the key holder of the present invention is so constructed that the entire assortment of keys or other articles on the ring may be circulated around at least a portion of the ring for the purpose of selecting a desired key to be removed or selecting the desired point in which to insert an added key or like element.

Certain metals, which are known to have the characteristic of returning to an original shape and which may be usefully employed in construction of the key rings of the present invention, are listed in the January 1988 issue of Popular Science, page 78, "Metals That Remember" by Steven Ashley. In addition, the retainer of the present invention could be made of any rigid resilient plastic material such as high density polyethylene or polypropylene, polycarbonates, thermoplastic elastomers, and other thermoplastic or thermoset polymeric materials. Such materials are well known to those skilled in the metal or polymeric materials arts.

DESCRIPTION OF THE DRAWINGS AND THE PREFERRED EMBODIMENTS

FIG. 1 is a front view of the key holder 10 showing the push bar 11 extending like a diameter almost to the opposite side of the ring.

FIG. 2 is a rear view of the key holder 10 shown in FIG. 1 showing the push bar 11. Note that in FIGS. 1 and 2 the space between the terminal portion of the push bar and the ring is not large enough to allow a key to slide off while the push bar is in the closed position.

Figure 1:
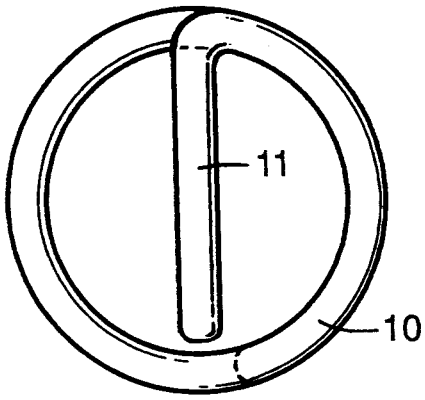
Figure 2:
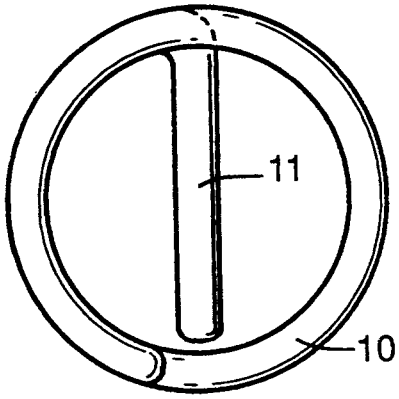
Figure 3:
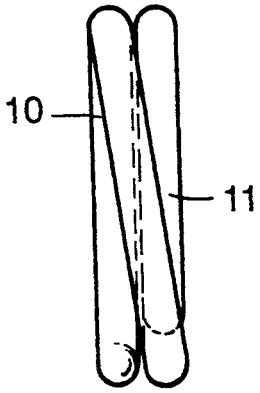
FIG. 3 is a side view of the key holder 10 showing the push bar 11 in a static at rest position.
Figure 4:
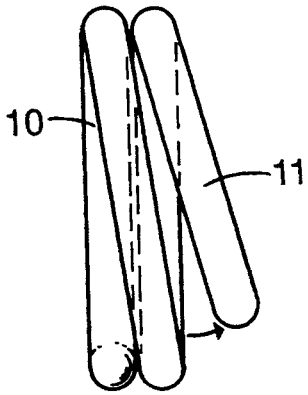
FIG. 4 is the same view as FIG. 3 except that the push bar 11 has been pushed out into an open position so as to receive a key.
Figure 5:
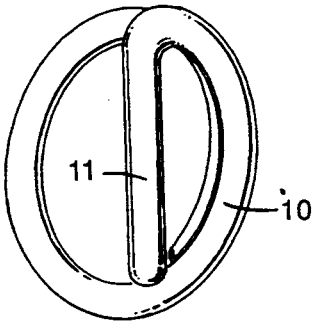
FIG. 5 is a perspective view of the key holder 10 shown in FIGS. 1 to 4.
Figure 6:
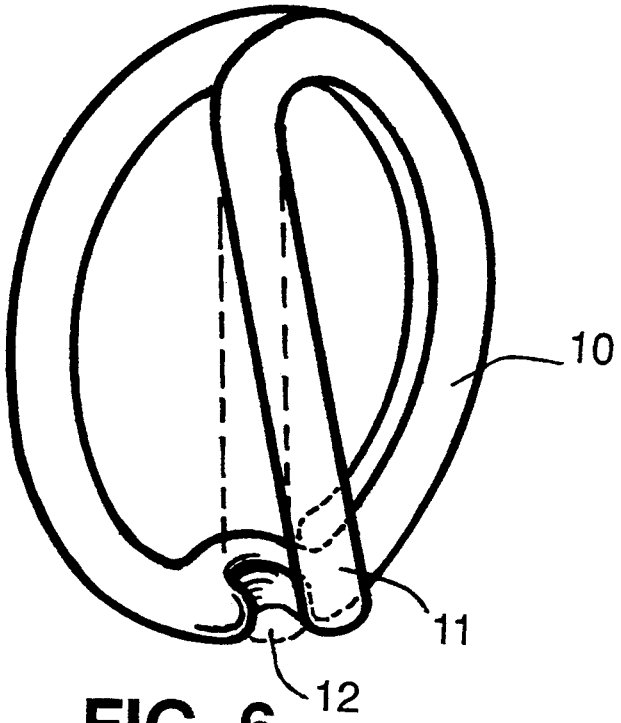

FIG. 6 show one embodiment where in the key holder 10 contains a notch 12 for receiving the push bar 11 when it is in a static at rest position. In one embodiment (not shown), the notched portion of the ring is of slightly greater thickness (not shown) than the cross-section of the ring so as to strengthen the notched area.

Figure 7:
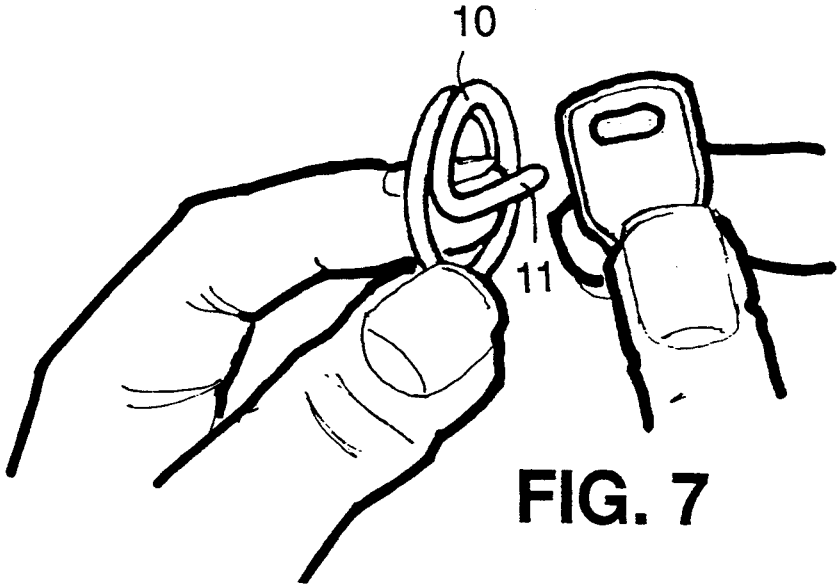

FIG. 7 shows the push bar position being activated in an open position to receive a key 13.

Figure 8:
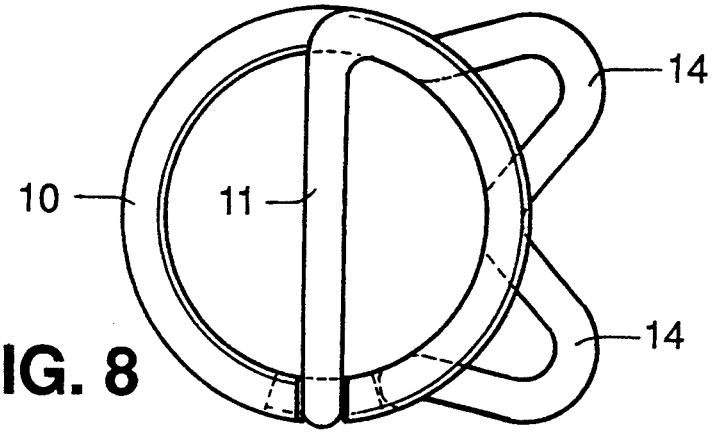
Figure 9:
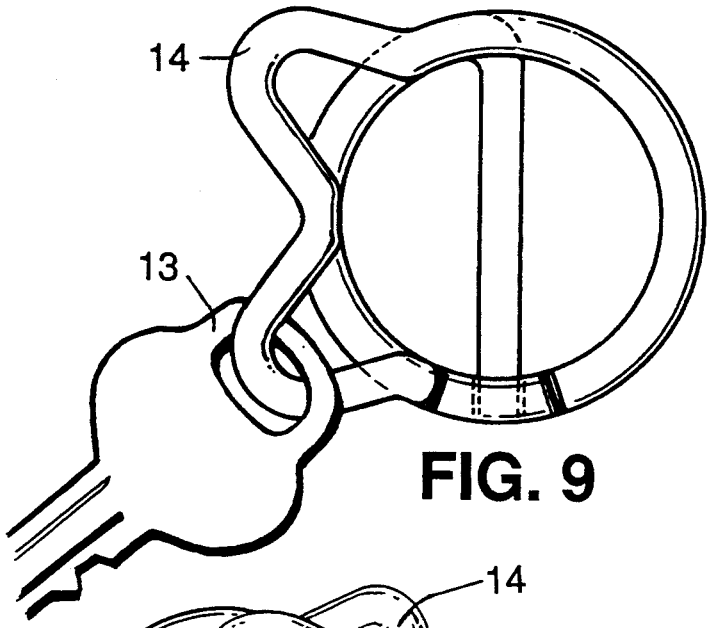

FIG. 8 shows one embodiment wherein two lobes 14 are formed on the coil of the key holder 10 which allows one or more keys 13 to be isolated as shown in FIG. 9. In this embodiment one or more such lobes are formed on the key holder to isolate various keys for various locks, e.g. car, home, office, etc. Such an embodiment helps to facilitate quick access to such keys isolated on the lobe or lobes.

Figure 10:
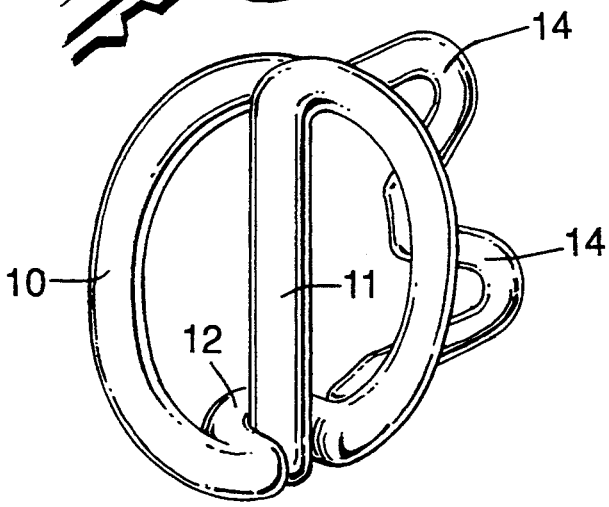

FIG. 10 shows the reverse side of the ring shown in FIG. 9.

Figure 11A:
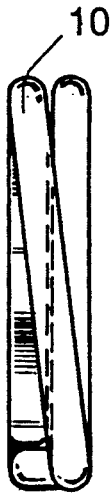
Figure 11B:
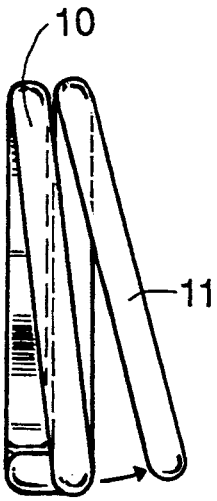

FIG. 11 is an end view of the key holder of FIG. 10 showing the ring in a closed position (A) and with the push bar pushed out so as to receive a key (B) .

While the present invention has particular application as a key holder, it may also be employed to receive and retain other orificed or closed loop elements which may be slipped onto the ring herein illustrated and described. Among such orificed or closed loop elements for which the invention may be particularly useful are trinkets, emblems, name tags, whistles, flashlights and the like.

As shown in the Figures, the push bar, which is diameter like, also acts as a stop barrier which can be used to segregate keys on one or more portions of the ring.

Although the various described versions of the key holder of the present invention are shown in the Figures as having a substantially round cross-section, it is contemplated that the key holders of the present invention may be constructed with a great number of cross-sectional geometries and overall shapes and still be within the spirit of this invention.

I claim:

1. A key holder comprising a ring shaped element formed from a resilient coil of material having a notched portion in the coil for receiving the terminal portion of one end of the coil wherein one end of the coil used to form the key holder extends diametrically across the area defined by the ring shaped element and wherein the terminal portion of the said end fits into the notched portion.

2. The key holder as in claim 1 wherein the ring shaped element contains at least one lobe for isolating one or more keys on the ring.

* * * * *